United States Patent [19]

Henrich et al.

[11] 4,211,515

[45] Jul. 8, 1980

[54] MARINE PROPELLER FISH LINE AND WEED CUTTER

[75] Inventors: Donald A. Henrich, Lake Villa; Edgar Rose, Glencoe, both of Ill.

[73] Assignee: Outboard Marine Corporation, Waukegan, Ill.

[21] Appl. No.: 18,122

[22] Filed: Mar. 7, 1979

Related U.S. Application Data

[62] Division of Ser. No. 878,323, Feb. 16, 1978.

[51] Int. Cl.[2] ..... B63H 1/26

[52] U.S. Cl. ..... 416/146 R; 416/93 A

[58] Field of Search ..... 416/146 R, 146 A, 93 A

[56] References Cited

U.S. PATENT DOCUMENTS

| | | | |
|---|---|---|---|
| 1,390,397 | 9/1921 | Svenson | 416/146 R |
| 1,813,540 | 7/1931 | Laska | 416/146 R |
| 2,143,693 | 1/1939 | Harris | 416/146 R |
| 3,371,720 | 3/1968 | Blanchard | 416/146 R |
| 3,563,670 | 2/1971 | Knuth | 416/93 A |
| 3,619,083 | 11/1971 | Witte | 416/146 R X |
| 3,871,324 | 3/1975 | Snyder | 416/93 A |
| 3,876,332 | 4/1975 | Kashmerick | 416/93 A |
| 4,080,099 | 3/1978 | Snyder | 416/146 R |

*Primary Examiner*—Everette A. Powell, Jr.

*Attorney, Agent, or Firm*—Michael, Best & Friedrich

[57] ABSTRACT

Disclosed herein is a marine propulsion device comprising a lower unit including a gear case including a hollow interior having at the rearward end thereof an inwardly extending inner circular surface defining an opening through which exhaust gases and engine cooling water are discharged from the lower unit, a propeller shaft rotatably journalled in the gear case and including a portion extending rearwardly of the gear case, a propeller including an inner part mounted on the propeller shaft rearward portion for common rotation of the inner part with the propeller shaft, an outer part having an outer circular surface with a diameter materially less than the diameter of the inner circular surface of the gear case, a blade extending radially outwardly from the outer part, and a resilient cushion connecting the inner and outer parts, and a thrust washer carried by the propeller shaft in forward thrust transmitting engagement therewith and in forward thrust receiving engagement with the propeller outer part, and a fish line and weed cutter extending from the thrust washer into the area between the inner circular surface of the gear case and the outer circular surface of the outer part of the propeller for cutting fish lines and weeds.

Also disclosed herein is the provision on a propeller blade of a leading edge having therein a forwardly open slot, and a cutter fixedly mounted on the lower unit and extending rearwardly for passage through the slot so as to provide a shearing action in response to rotation of the propeller.

4 Claims, 21 Drawing Figures

Fig. 1
PRIOR ART
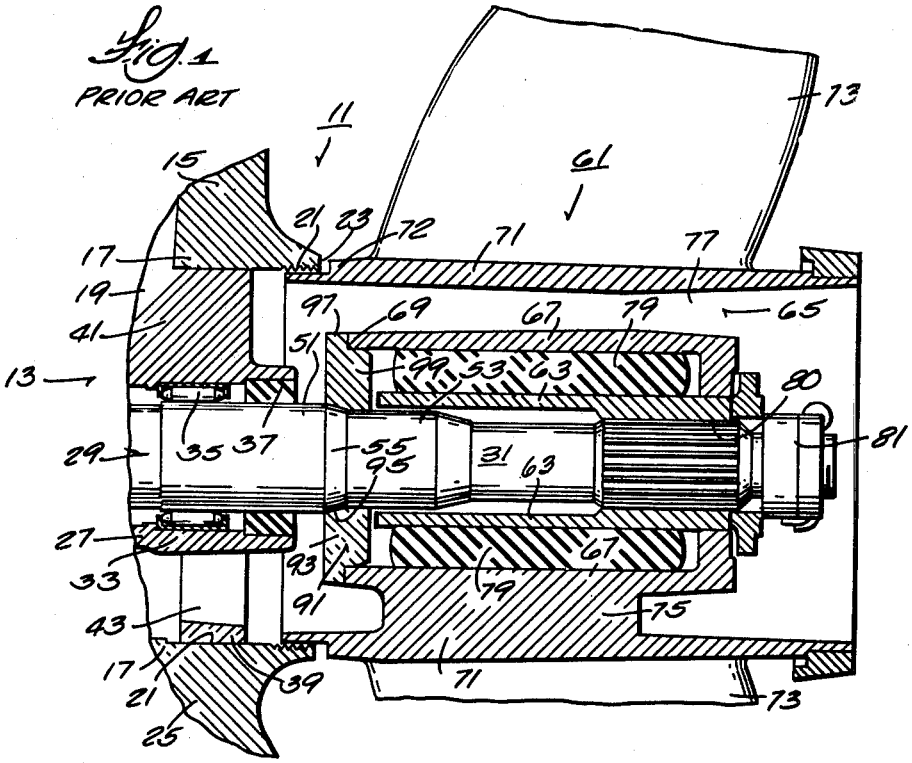
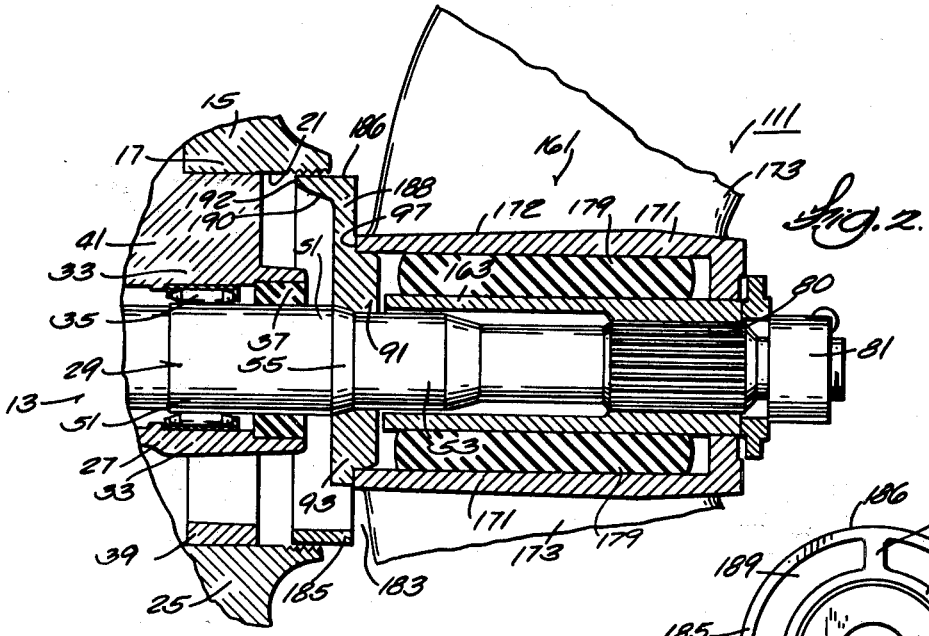
Fig. 2.
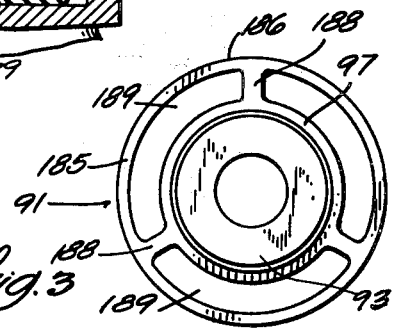
Fig. 3

MARINE PROPELLER FISH LINE AND WEED CUTTER

This is a division of application Ser. No. 878,323 filed Feb. 16, 1978.

BACKGROUND OF THE INVENTION

The invention relates generally to marine propulsion devices such as outboard motors and stern drive units. More particularly, the invention relates to fish line and weed cutters for such devices.

Attention is directed to the Kiekhaefer U.S. Pat. No. 3,102,506 issued Sept. 3, 1963 and to the Witte U.S. Pat. No. 3,619,083 issued Nov. 9, 1971, as well as to the prior construction disclosed hereinafter and shown in FIG. 1.

Attention is also directed to the Kashmerick U.S. Pat. No. 3,856,332 issued Apr. 8, 1975 and to the Kashmerick U.S. Pat. No. 3,937,073 issued Feb. 10, 1976.

SUMMARY OF THE INVENTION

The invention provides a marine propulsion device comprising a lower unit including a gear case including a hollow interior having at the rearward end thereof an inwardly extending inner circular surface defining an opening through which exhaust gases and engine cooling water are discharged from the lower unit, a propeller shaft rotatably journalled in the gear case and including a portion extending rearwardly of the gear case, a propeller including an inner part mounted on the propeller shaft rearward portion for common rotation of the inner part with the propeller shaft, an outer part having an outer circular surface with a diameter materially less than the diameter of the inner circular surface of the gear case, a blade extending radially outwardly from the outer part, and resilient means connecting the inner and outer parts, and a thrust washer carried by the propeller shaft in forward thrust transmitting engagement therewith and in forward thrust receiving engagement with the propeller outer part, and means on the thrust washer extending into the area between the inner circular surface of the gear case and the outer circular surface of the outer part of the propeller for cutting fish lines and weeds.

The invention also provides a marine propulsion device including a lower unit, a propeller shaft rotatably supported by the lower unit and including a portion extending rearwardly of the lower unit, a propeller mounted on the rearward portion of the propeller shaft for common rotation therewith and including a radially outwardly extending blade with a leading edge having therein a forwardly open slot, and cutter means fixedly mounted on the lower unit and extending rearwardly for passage through the slot so as to provide a shearing action in response to rotation of the propeller.

One of the features of the invention is the provision of a fish line and weed cutting means in a marine propulsion device in which exhaust gases are discharged from the drive shaft housing for rearward travel in the area around the periphery of the outer hub of a propeller.

Another of the features of the invention is the provision of a fish line and weed cutting means which extends fixedly from the gear case of a marine propulsion lower unit and into a slot in the forward edge of a propeller blade to cause sheering action in response to propeller blade rotation.

Other features and advantages of the embodiments of the invention will become known by reference to the following description, to the appended claims, and to the drawings.

THE DRAWINGS

FIG. 1 is a fragmentary side elevational view, partially in section, of a prior marine propulsion device.

FIG. 2 is a fragmentary view similar to FIG. 1 illustrating a portion of a marine propulsion device which embodies various of the features of the invention.

FIG. 3 is a view seen from the right, i.e., looking toward the left, of the thrust washer or ring incorporated in the marine propulsion device shown in FIG. 2.

PRIOR ART

Figure 4:
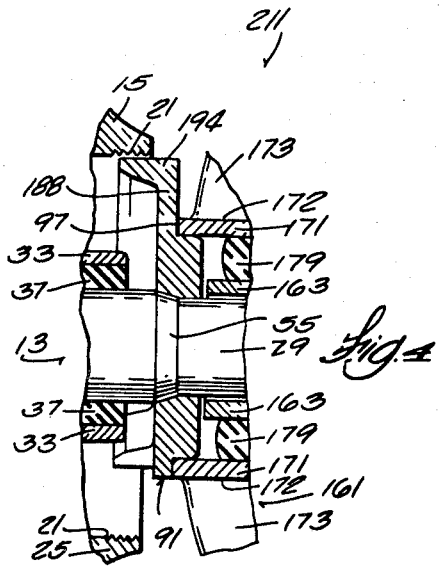
FIG. 4 is a fragmentary view similar to FIG. 1 illustrating a portion of another embodiment of a marine propulsion device which embodies various of the features of the invention.

Shown fragmentarily in FIG. 1 of the drawings is a prior marine propulsion device 11, such as an outboard motor or a stern drive unit, including a lower unit 13 which, preferably, is mountef for both horizontal steering movement and vertical tilting movement.

The lower unit 13 includes a drive shaft housing 15 which, at its lower end, terminates in a gear box or case 17 which includes a hollow interior 19 having, at the rearward end thereof, an inner cylindrical surface 21 which can include, adjacent the rearward margin thereof, a series of convolutions and which terminates rearwardly at a rearwardly facing gear case edge or surface 23. Extending below the gear case 17 is a skeg 25.

Suitably fixed within the gear case 17 is a bearing retainer 27 which, in part, rotatably supports a propeller shaft 29 which includes a rearward portion 31 extending aft of the retainer 27 and the gear case 17. The retainer 27 can be fixed to the gear case 17 is any suitable manner, as disclosed, for instance, in the Kashmerick U.S. Pat. No. 3,937,073 issued Feb. 10, 1976 and includes a central hub portion 33 which supports one or more bearings, as for instance a series of roller bearings 35, and rearwardly of the bearings 35, a lubricant seal 37 between the retainer 27 and the propeller shaft 29.

The retainer 27 also includes an outer annular portion 39 which engages a part of the cylindrical inner surface 21 of the bear case 17 and which is supported from the central hub portion 33 by one or more ribs or spokes 41, for instance, two or three equi-angularly spaced ribs 41 can be employed. The area between the inner or central hub portion 33, the outer annular portion 39, and between the ribs 41 defines a plurality of openings or apertures 43 through which exhaust gases and engine cooling water are discharged from the drive shaft housing 15.

The propeller shaft portion 31 extending rearwardly of the bearing retainer 27 and gear case 17 includes a forward part 51 having a first diameter, a rearward part 53 having a second diameter of less dimension than the first diameter, and a thrust receiving transition part 55 which is located between the forward part 51 and rearward part 53 and which, in the disclosed construction, is conical in formation, but could be of other configurations.

Mounted on the rearward portion of the propeller shaft 29, rearwardly of the thrust receiving part 55, is a propeller 61 which includes an inner hub 63 received on the propeller shaft 29, together with an outer hub assembly 65 which includes an intermediate hub 67 having a forward end 69, and an outer hub 71 having a forward end 72 which can be stepped as shown and which extends somewhat into the hollow interior 19 of the gear case 17 in close proximity to the inner cylindrical surface 21 to substantially prevent the escape of exhaust gases and the entry of fish line and weeds. The outer hub assembly 65 also includes a series of blades 73 extending from the outer hub 71, and a series of equiangular spaced ribs or spokes 75 which interconnect the intermediate and outer hubs 67 and 71 to define a plurality of exhaust gas and engine cooling water discharge passages 77 which communicate with the apertures 43 in the bearing retainer 27. The outer hub assembly 65 is connected to the inner hub 61 by a resilient cushion or member 79 so as to absorb shock and to permit a limited amount of relative rotation between the inner 63 and outer hub assembly 65.

Any suitable means, as for instance, a spline connection 80, can be employed to provide for common rotation of the propeller shaft 29 and the inner hub 63 of the propeller 61.

Any suitable means can be employed, such as a nut 81 to retain the propeller 61 on the propeller shaft 29 and to provide for transmission of reverse thrust from the intermediate hub 67 of the propeller 61 to the propeller shaft 29.

Forward propeller thrust is transmitted from the intermediate hub 67 of the propeller 61 to the propeller shaft 29 through a thrust ring or washer 91. More particularly, the thrust ring or washer 91 includes a central or hub portion 93 which is apertured to permit passage therethrough of the propeller shaft 29, which aperture is defined, in part, by a thrust transmitting surface 95 which engages the thrust receiving part 55 of the propeller shaft 29 for transmission of forward thrust from the thrust ring 91 to the propeller shaft 29.

The central portion 93 also includes an annular surface 97 extending generally perpendicular to the propeller axis and adapted for engagement with the forward end 69 of the intermediate hub 67 for transmission of forward thrust from the intermediate hub 67 of the propeller 61 to the thrust ring 91.

Still further, the central portion 93 includes a pilot part 99 which extends slightly into a recess in the propeller 61 between the inner and intermediate hubs 63 and 67 and which serves to assist in registry of the forward end 69 of the intermediate hub 67 with the thrust ring annular surface 97.

The above disclosed construction is prior and is shown, at least in part, in U.S. Pat. No. 3,876,332 issued Apr. 8, 1975.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purposes of description and should not be regarded as limiting.

GENERAL DESCRIPTION OF THE INVENTION

Shown in FIG. 2 is a marine propulsion device 111 such as, for instance, an outboard motor or a stern drive unit, which device is constructed in a similar manner to the device 11 shown in FIG. 1 except that a different propeller 161 is employed and except that, in the construction shown in FIG. 2, the thrust receiving ring or washer 91 also includes fish line and weed cutting means.

The components of the construction shown in FIG. 2 which are similar to those of the construction shown in FIG. 1 are identified with the same reference numerals and, hence, a description of these components in detail is not believed necessary in view of the foregoing description with respect to FIG. 1.

More specifically, with respect to the differences in the propeller construction, the propeller 161 includes an inner part or hub 163 received on the propeller shaft 29 for common rotation therewith, an outer part or hub 171 having an outer surface 172 with a diameter materially less than the diameter of the inner cylindrical surface 21 of the gear case 17, one or more blades 173 fixedly extending outwardly from the outer surface 172 of the outer hub 171, together with a resilient cushion or member 179 connected or bonded to each of the inner or outer hubs 163 and 171 so as to absorb shock and to permit a limited amount of relative rotation between the inner and outer hubs 163 and 171.

As the outer surface 172 of the outer hub 171 of the propeller 161 has a diameter materially less than the diameter of the inner cylindrical surface 21 of the gear case 17, there is an annular space 183 outwardly of the outer surface 172 of the outer hub 171 and inwardly of the inner cylindrical surface 21 through which the exhaust gases and engine cooling water are discharged into the path of the radially inner part of the propeller blades 173.

The fish line or weed cutting means on the thrust ring 91 acts to cut fish or weeds which may attempt to travel toward the propeller shaft 29 through the annular space 183 between the outer surface 172 of the propeller outer hub 171 and the inner cylindrical surface 21 of the gear case 17. While various configurations can be employed, in the construction shown in FIG 1, such means comprises a radially outwardly spaced sleeve or collar 185 which extends forwardly from the plane of the bearing surface 97, which has an outer cylindrical surface 186 closely spaced in inward telescopic relation to a part of the inner cylindrical surface 21 of the gear case 17 so as to wipe the surface 21, and which is supported from the central portion 93 of the thrust washer 91 by one or more ribs, spokes or struts 188 which extend radially outwardly from the central portion 93 of the thrust ring 91 to the outer sleeve 185 and which, together with the outer sleeve 185 and central portion 93, define a series of passageways or openings 189 through which exhaust gas and engine coolant water are discharged from the apertures or openings 43. In the construction illustrated in FIG. 2, three angularly spaced ribs, spokes or struts 188 are employed. As can be seen from FIG. 2, the forward edge 190 of each strut 188 inclines forwardly and outwardly from the area of the central portion 93 to the forward edge 192 of the collar or sleeve 185.

During operation, forward thrust is transmitted from the outer propeller hub 171 through the thrust washer 91 to the propeller shaft 29. Such thrust transmission causes rotation of the thrust ring or washer 91 with the outer propeller hub 171 and propeller 61. As a consequence of such thrust washer rotation, the rapidly rotating ribs or spokes 188 of the thrust washer or ring 91 serve to cut or shred fish line or weeds which attempt to travel inwardly through the space 183 between the outer cylindrical surface 172 of the outer hub 171 and the inner cylindrical surface 21 of the gear case 17 toward the propeller shaft 29. The discharge of exhaust gases and engine coolant water rearwardly from the gear case 17 through the space 183 helps to carry such resulting shreads rearwardly away from the propeller 61.

Fragmentarily shown in FIG. 4 is another marine propulsion device 211 including a thrust ring or washer 91 incorporating fish line and weed cutting means. As the construction shown in FIG. 4 is substantially identical to the construction shown in FIG. 2, except as noted below, the same reference numerals have been applied to the components in the FIG. 4 construction which correspond to like components of the FIG. 2 construction.

Figure 5:
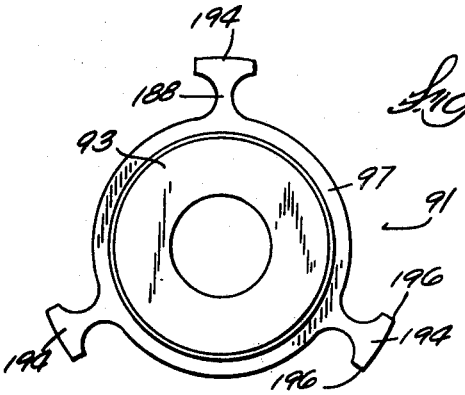
FIG. 5 is a view seen from the right, i.e., looking toward the left, of the thrust washer or ring incorporated in the marine propulsion device shown in FIG. 4.

The construction shown in FIG. 4 differs from the construction shown in FIG. 2 by reason of omission of major portions of the collar or sleeve 185 between the ribs or spokes 188. Thus the spokes 188 terminate (see FIG. 5) at their radial outer ends with respective heads 194 having outer surfaces which constitute relatively short segments of a cylinder, which are located in closely adjacent relation to the inner cylindrical surface 21 and which wipe the surface 21. it is to be noted that the axially extending edges 196 of the heads 194, to the extent they extend rearwardly beyond the gear case 17, also serve to assist in shredding fish line or weeds attempting to travel toward the propeller shaft 29.

Figure 6:
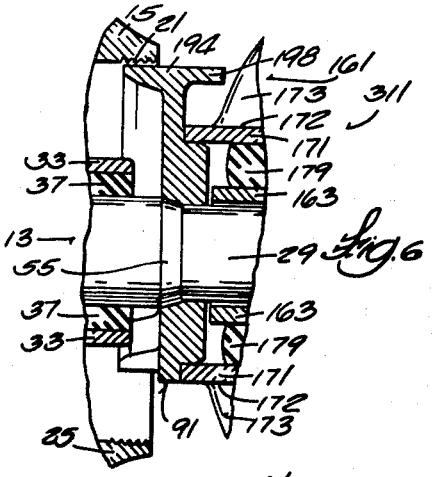
FIG. 6 is a fragmentary view similar to FIG. 1 illustrating still another embodiment of a marine propulsion device which embodies various of the features of the invention.

Fragmentarily shown in FIG. 6 is still another marine propulsion device 311 incorporating a thrust ring or washer 91 including fish line and weed cutting means. As the construction shown in FIG. 6 is substantially identical to that shown in FIG. 4, except as noted below, the same reference numerals have been applied to the components of the FIG. 6 construction which correspond to like components of the FIG. 4 construction.

The construction shown in FIG. 6 differs from the construction shown in FIG. 4 by reason of enlargement of the heads 194 to include rearwardly projecting portions or teeth or prongs 198 (see FIG. 6) which extends rearwardly from the gear case 17 into the area just forwardly of the propeller blades 173 and in outward, radially spaced relation from the outer surface 172 of the outer hub 171 of the propeller 161. The axially extending edges 196 extending rearwardly from the gear case 17 serve to additionally shred fish line and weeds attempting travel toward the propeller shaft 29 in the same manner as referred to with respect to the construction shown in FIG. 4.

Figure 8:
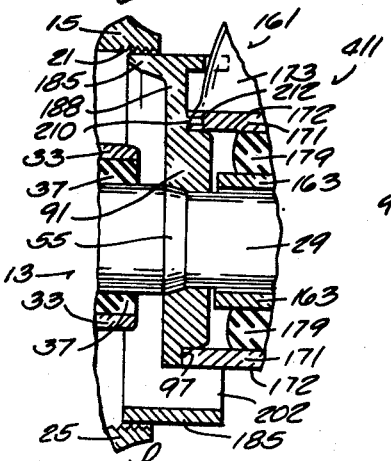
FIG. 8 is a fragmentary view similar to FIG. 1 illustrating still another embodiment of a marine propulsion device which embodies various of the features of the invention.

Fragmentarily shown in FIG. 8 is another marine propulsion device 411 incorporating a thrust ring or washer 91 including fish line and weed cutting means. As the construction shown in FIG. 8 is substantially identical to the construction shown in FIG. 2, except as noted below, the same reference numerals have been applied to the components of the FIG. 8 construction which correspond to like components of the FIG. 2 construction.

The construction shown in FIG. 8 differs from the FIG. 2 construction by reason of extension of the collar or sleeve 185 for a substantial distance rearwardly from the plane of the annular bearing surface 97 of the thrust ring 91 and into the area within the rotary path of the blades 173 and in that, in the FIG. 8 construction, the spokes 188 terminate in a collar or sleeve 185, whereas in the FIG. 6 construction, the spokes 188 terminate in respective heads 194. Because of the extent of the extension of the collar or sleeve 185 rearwardly and in order to avoid any interference with the base of the propeller blades 173 near the outer hub 171 of the propeller 161, the rearward edge 202 of the collar 185 includes, for each propeller blade 173, a notch 204 which receives the base of the associate propeller blade 73.

The construction shown in FIG. 8 also differs from the previous construction in that interfitting means are provided for insuring rotation of the fish line and weed cutting thrust ring 91 with the outer hub 171 of the propeller 161. While various arrangements can be employed, in the illustrated construction, the thrust ring 91 includes a pin or key 210 which extends rearwardly from the annular bearing surface 97 in parallel relation to the axis of the propeller 161 and the forward end of the outer hub 171 includes a recess or notch or slot 212 which receives the pin 210 so as to positively cause rotation of the thrust washer 91 in response to rotation of the outer hub 171 of the propeller 161. Of course, the notch 212 is located relative to the pin 210 so as to afford receipt of the blades 173 of the propeller 161 in the notches 204. If desired, the slot can be provided in the thrust washer 91 and the outer hub 171 can be provided with a key receivable into the slot in the thrust washer.

Figure 11:
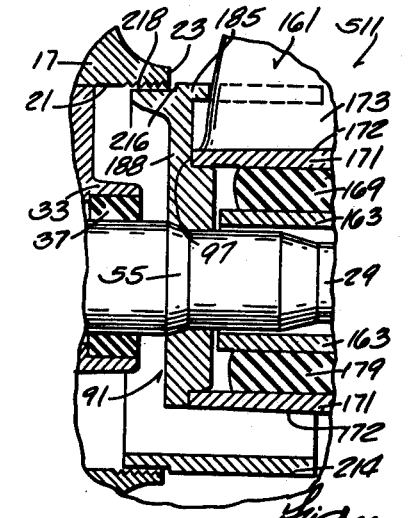
FIG. 11 is a fragmentary view similar to FIG. 1 illustrating still another embodiment of a marine propulsion device which embodies various of the features of the invention.
Figure 13:
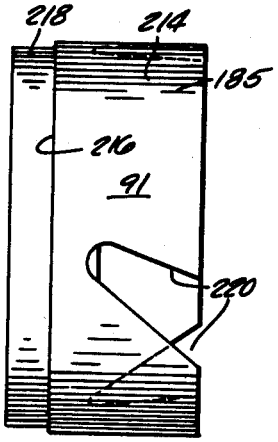
FIG. 13 is a side elevational view of the thrust ring or washer incorporated in the marine propulsion device shown in FIG. 11.
Figure 12:
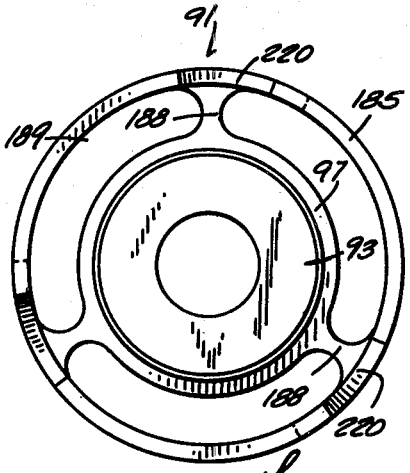
FIG. 12 is a view seen from the right, i.e., looking toward the left, of the thrust washer or ring incorporated in the marine propulsion device shown in FIG. 11.

Fragmentarily shown in FIG. 11 is another embodiment of a marine propulsion device 511 incorporating a thrust ring or washer 91 including fish line and weed cutting means. As the construction shown in FIG. 11 is substantially identical to the construction shown in FIG. 2, except as noted below, the same reference numerals have been applied to the components of the FIG. 11 construction which correspond the like components of the FIG. 2 construction.

The construction shown in FIG. 11 differs primarily from the construction shown in FIG. 2 in that, the collar 185 includes a forward or main portion 218 and a rearward or end portion 214 extending rearwardly from the plane of the annular bearing surface 97 for a substantial distance and in that the portion 214 of the collar 185 extending rearwardly from the gear case 17 is of greater diameter than the diameter of the forwardly located portion 218 of the collar 185 and is of greater diameter than the diameter of the inner cylindrical surface 21 of the gear case 17. The shoulder 216 between the rearward collar portion 214 and the forward or main portion 218 of the collar 185 is located in slightly spaced relation rearwardly from the rearward edge 23 of the gear case 17.

As the rearwardly projecting collar portion 214 extends rearwardly into the rotational path of the blades 173, the rearward edge of the rearwardly extending collar portion 214 is provided, for each of the blades 173, with a notch 220 which receives the associated blade 173 and enters into engagement with the blade 173 so as to provide for positive driving of the thrust ring washer 91 by the propeller blade 173.

Figure 14:
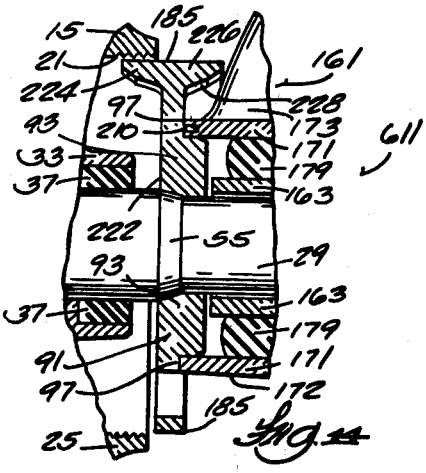
FIG. 14 is a fragmentary view similar to FIG. 1 illustrating a portion of another embodiment of a marine propulsion device which embodies various of the features of the invention.
Figure 15:
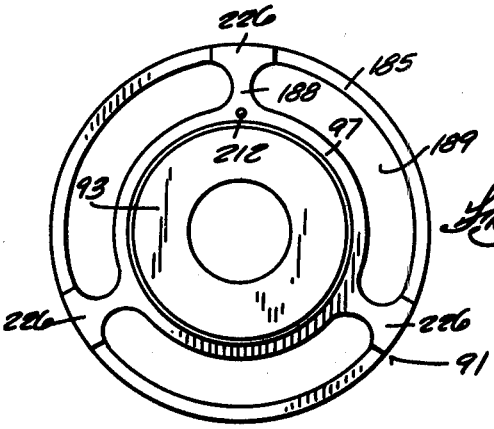
FIG. 15 is a view seen from the right, i.e., looking toward the left, of the thrust washer or ring incorporated in the marine propulsion device shown in FIG. 14.

Fragmentarily shown in FIG. 14 is still another marine propulsion device 611 incorporating a thrust washer 91 including fish line and weed cutting means. As the construction shown in FIG. 14 is substantially identical to that shown in FIG. 2, except as noted below, the same reference numerals have been applied to the components of the FIG. 14 construction which correspond to like components of the FIG. 2 construction.

Figure 7:
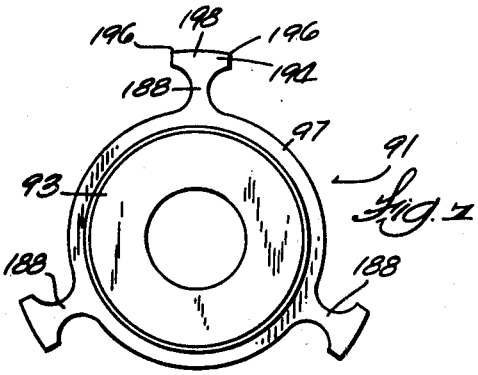
FIG. 7 is a view seen from the right, i.e., looking toward the left, of the thrust washer or ring incorporated in the marine propulsion device shown in FIG. 6.

The construction shown in FIG. 14 differs from the construction shown in FIG. 2 in that, the collar 185 is of considerably less axial extent than in the construction shown in FIG. 2 and in that the collar 185 is located so as to surround a greater portion of the central portion 93 of the thrust ring 91. That is, the collar 185 extends rearwardly from the forward face 222 of the central portion 93 of the thrust ring 91 to slightly beyond the annular bearing surface 97. In addition, the collar 185 shown in FIG. 14 is provided, along its forward edge, with a series of teeth or projections 224 which have limited arcuate extent and which extend to adjacent the inner cylindrical surface 21 of the gear case 17. The forwardly extending teeth or projections 224 resemble the heads 194 referred to in FIGS. 4 and 5. The collar 185 shown in FIG. 14 is also provided along its rearward edge with a series of teeth or projections 226 which extend rearwardly in alignment with the teeth or projections 224 and which resemble the projecting portions 198 illustrated in FIGS. 6 and 7. As contrasted to the construction in FIGS. 6 and 7, it is noted that the spokes 188 include rearward edges 228 which incline rearwardly and outwardly toward the rearward ends of the rearward projections or teeth 226.

Figure 10:
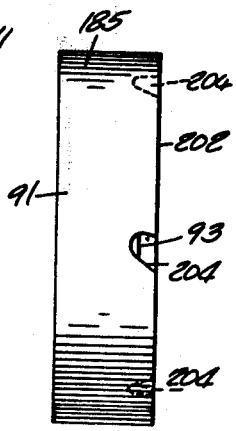
FIG. 10 is a side elevational view of the thrust ring or washer incorporated in the marine propulsion device shown in FIG. 8.
Figure 9:
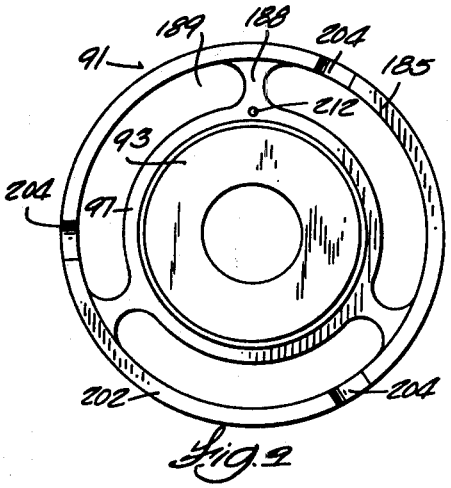
FIG. 9 is a view seen from the right, i.e., looking toward the left, of the thrust washer or ring incorporated in the marine propulsion device shown in FIG. 8.

Also included in the construction shown in FIG. 14 are interfitting means for positively rotating and thrust ring 91 from the outer hub 171 of the propeller 161 in the form of the pin and slot construction 210 and 212 disclosed in connection with the embodiment shown in FIGS. 8, 9 and 10.

Figure 16:
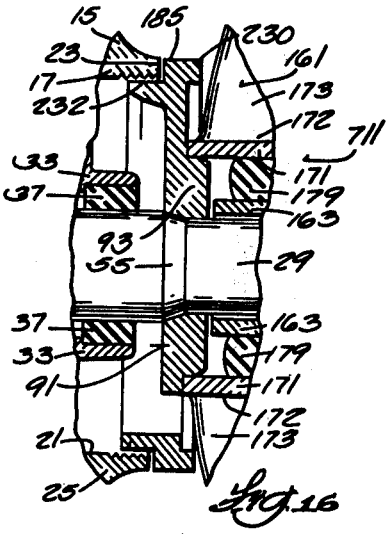
FIG. 16 is a fragmentary view similar to FIG. 1 illustrating still another embodiment of a marine propulsion device which embodies various of the features of the invention.
Figure 17:
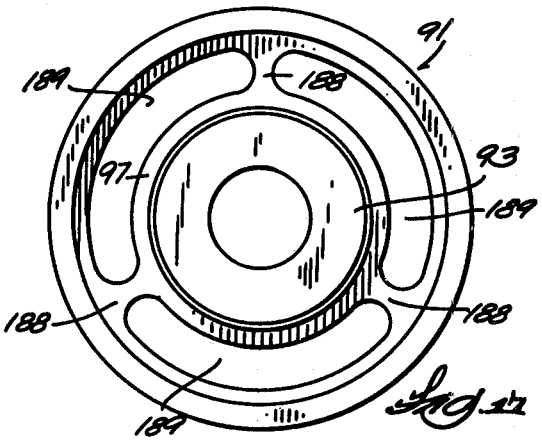
FIG. 17 is a view seen from the right, i.e., looking toward the left, of the thrust washer or ring incorporated in the marine propulsion device shown in FIG. 16.

Fragmentarily shown in FIG. 16 is another marine propulsion device 711 incorporating a thrust ring and washer 91 including fish line and weed cutting means. As the construction shown in FIG. 16 is substantially identical to the construction shown in FIG. 2, except as noted below, the same reference numerals have been applied to the components of the construction shown in FIG. 16 which correspond to like components of the construction shown in FIG. 2.

The construction shown in FIG. 16 differs from the construction shown in FIG. 2 in that the collar 185 includes an outer surface having a rearward portion 230 and a forward portion 232. In this last regard, the forward portion 232 extends continuously in the circumferential sense and has an outer diameter which is slightly less than the diameter of the inner cylindrical surface 21 of the gear case 17. The rearward or larger diameter portion 230 of the outer surface of the collar extends from just rearwardly of the terminal edge 23 of the gear case 17 at the rearward end of the inner cylindrical surface 21 for a distance approximately that shown in the construction shown in FIG. 14. In other respects, the construction shown in FIG. 16 is generally identical to the construction disclosed in FIG. 2.

Figure 18:
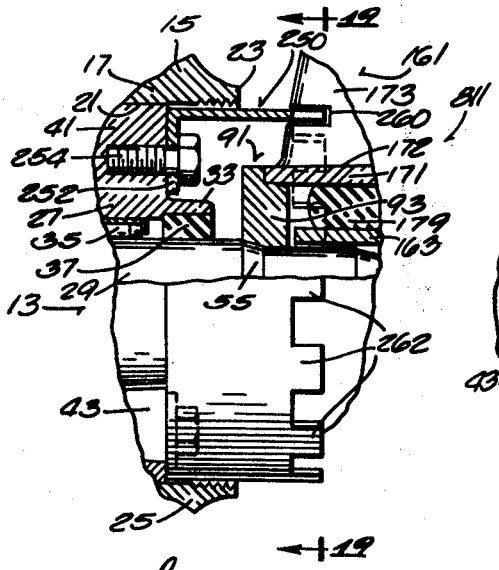
FIG. 18 is a fragmentary view similar to FIG. 1 illustrating still another embodiment of a marine propulsion device which embodies various of the features of the invention.
Figure 19:
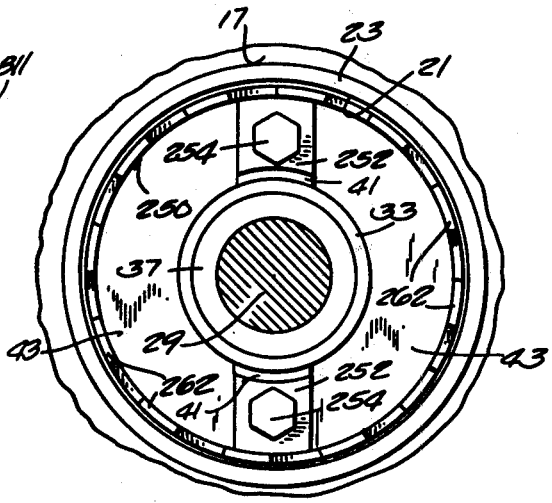
FIG. 19 is a fragmentary sectional view taken along line 19—19 of FIG. 18.

Fragmentarily shown in FIG. 18 is another embodiment of a marine propulsion device 811, such as an outboard motor or stern drive unit, and which is constructed in a manner similar to that shown in FIG. 2, except as noted hereafter. Various components of the construction shown in FIG. 18 have been identified by the same reference numerals which have been applied to like components of the construction shown in FIG. 2. Accordingly, the description of these components is believed to be unnecessary.

The marine propulsion device 811 includes a fish line or weed cutter construction which is mounted stationarily as distinguished from the rotary thrust ring cutters previously described.

In the construction shown in FIG. 18, the thrust washer 91 is limited in size to the central portion 93 (as is shown in FIG. 1) and the weed cutting means comprises a cutter 250 in the form of a cylinder which includes, adjacent the forward end thereof, inwardly extending brackets or tabs 252 affording fixed attachment of the cutter 250 to the ribs 41 of the bearing retainer 27, by any suitable means, such as by screws 254. The cylindrical cutter 250 has a diameter very slightly smaller than the diameter of the inner cylindrical surface 21 of the gear case or box 17 and extends rearwardly into the path of rotation of the propeller blades 173. Accordingly, to permit propeller rotation, the propeller blades 173 each include, at the leading edge thereof, a forwardly open slot 260 which receives the rearward portion of the weed cutter 250.

In order to provide a cutting action, the rearward edge of the weed cutter 250 is notched so as to provide a series of teeth 262 which are evenly spaced from each other at a distance corresponding to the arcuate extent of the teeth 262. Other teeth arrangements can be employed, as for instance, the number of teeth can be reduced to two or three or four of the size shown in FIG. 18 or other sizes and the spacing and number of teeth can be employed.

In operation, passage of the weed cutter 250 through the propeller blade slots 260 serves to shred fish line or weeds extending into the area between the teeth 262.

Figure 20:
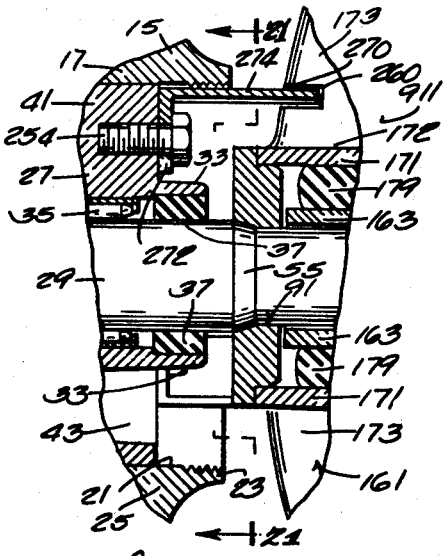
FIG. 20 is a fragmentary view similar to FIG. 1 illustrating a portion of another embodiment of a marine propulsion device which embodies various of the features of the invention.
Figure 21:
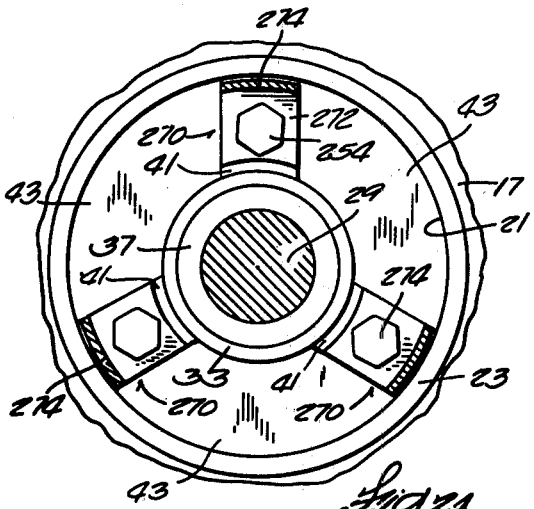
FIG. 21 is a fragmentary sectional view taken along line 21—21 of FIG. 20.

Shown in FIG. 20 is still another embodiment of a marine propulsion device 911 including a weed cutter construction which is similar to that shown in FIG. 18. In this regard, one or more tooth elements 270 are fixed by screws or otherwise to one or more of the ribs 41 of the bearing retainer 27 (three in the illustrated construction).

Each tooth element 270 is generally of L shape including a flat leg 272 which bears against the rib 41 of the retainer 27 and by which the tooth element 270 is attached to the retainer 27, as by screws 254 or otherwise, and a projecting leg 274 which is arcuate in cross-section in a plane perpendicular to the propeller axis and which projects rearwardly from immediately within the inner cylindrical surface 21 of the gear case 17 for a substantial distance beyond the rearward edge 23 of the gear case 17 and, as in the construction disclosed in FIG. 20, into the rotary path of the propeller blades 173. Accordingly, each of the propeller blades 173 is slotted at 260 as described with respect to the construction shown in FIG. 18. Thus, the operation of the embodiment shown in FIG. 20 is substantially the same as the operation shown in FIG. 18.

It is to be noted that, in all the embodiments the exiting exhaust gas and engine cooling water which is discharged from the gear case travels rearwardly along the outer surface 172 of the outer hub 171 of the propeller 161 so as to carry rearwardly shreded fish line or weeds and thereby to further minimize the possibility of the entering of fish line or weeds into the propeller shaft area.

Various of the features of the invention are set forth in the following claims.

What is claimed is:

1. A marine propulsion device including a lower unit having a gear case including a bearing retainer having a radially extending rib, a propeller shaft rotatably supported by said bearing retainer and including a portion extending rearwardly of said lower unit, a propeller mounted on said rearward portion of said propeller shaft for common rotation therewith and including a radially outwardly extending blade with a leading edge having therein a forwardly open slot, and cutter means comprising an L-shaped cutter including a radially extending leg fixedly mounted on said rib and a radially outer tooth element having a tooth portion which extends rearwardly for passage through said slot so as to provide a shearing action in response to rotation of said propeller.

2. A marine propulsion device in accordance with claim 1 wherein said tooth portion has an arcuate cross section in a plane perpendicular to the axis of said propeller.

3. A marine propulsion device in accordance with claim 1 wherein said L-shaped cutter comprises a part of a cylinder fixed to said retainer and having a rearward portion extending into the path of propeller rotation, said rearward portion having, at the rearward end thereof, a plurality of spaced teeth which travel through said propeller blade slot in response to propeller rotation.

4. A marine propulsion device in accordance with claim 1 wherein said gear case includes a hollow interior having at the rearward end thereof an inwardly extending cylindrical surface defining an opening through which exhaust gases and engine cooling water are discharged from the lower unit, wherein said propeller includes an inner part mounted on said propeller shaft rearward portion for common rotation of said inner path with said propeller shaft, and an outer part having an outer surface with a diameter substantially less than the diameter of said inner cylindrical surface of said gear case and having a forward end, said blade extending radially outwardly from said outer part, and resilient means connecting said inner and outer parts, and further including a thrust washer carried by said propeller shaft in forward thrust transmitting engagement therewith and in forward thrust receiving engagement with said outer part.

* * * * *